United States Patent [19]

Ephraim

[11] 4,450,993

[45] May 29, 1984

[54] KEYBOARD CARRIER

[76] Inventor: Bernard Ephraim, 1014 E. Olive St., Decatur, Ill. 62526

[21] Appl. No.: 425,439

[22] Filed: Sep. 28, 1982

[51] Int. Cl.[3] ..... G10G 5/00

[52] U.S. Cl. ..... 224/265; 224/272; 224/910

[58] Field of Search ..... 224/265, 272, 271, 270, 224/266, 910, 265, 272, 910

[56] References Cited

U.S. PATENT DOCUMENTS

| | | | |
|---|---|---|---|
| 3,009,613 | 11/1961 | Noland | 224/270 X |
| 3,106,123 | 10/1963 | Johannsen | 224/910 X |
| 4,256,007 | 3/1981 | Streit | 224/910 X |
| 4,387,839 | 6/1983 | Dranchak | 224/910 X |

*Primary Examiner*—Steven M. Pollard
*Attorney, Agent, or Firm*—Martin Faier

[57] ABSTRACT

A keyboard carrier having a brace and plate assembly attachable over the shoulders and along the belt line of a wearer, which comprises a u-shaped bracket extending from and connected by its legs to the brace and plate assembly, spaced apart arms each secured at its end to one leg of the bracket, a finger at an end of each arm, and a platform supported by the arms and secured to the fingers. The platform is adapted for mounting a keyboard thereon and has a plurality of friction pins extending therethrough arranged for securement to the keyboard. The platform may also have rod means adapted for pivotal securement in cooperating slots arranged in the arms.

9 Claims, 4 Drawing Figures

KEYBOARD CARRIER

BACKGROUND AND SUMMARY OF THE INVENTION

This invention relates to a keyboard carrier for use in a marching band or similar environment where it is necessary for the instrument to remain stable relative to the musician playing it, and the invention is more particularly directed to such a keyboard carrier which holds the instrument in a position where it will not slip or slide.

Portable carriers for conventional keyboards are not know because it has not been practical to use such instruments in a mobile environment. Such instruments are relatively expensive and not easy or practical to modify, and they must be played at a specific level relative to the musician, without much room for variation. Additionally, frequently such instruments require separate amplification and power packs for their use. All these factors complicate the potential for mobile use of keyboard instruments.

However, by use of a keyboard carrier embodying the present invention, the musician may comfortably carry his instrument without need to modify it in any way, and play the instrument in a conventional way at an appropriate height and position, without undue weight or pressure affecting his playing or mobility. Additionally, with his hands free and mobility unimpaired, the musician may sling a lightweight power pack and amplifier on his back, making it practical to use the keyboard in a marching band or similar portable environment. Furthermore, the keyboard carrier is so constructed as to permit the musician to easily remove the keyboard from the carrier or the carrier platform from its supporting structure to permit use of the keyboard in its normal stationary environment.

The structure by means of which the desired suitable portability of a keyboard is achieved comprises a brace and plate assembly attachable over the shoulders and along the belt line of a wearer, which has a u-shaped bracket extending from and connected by its legs to the brace and plate assembly. Spaced apart arms are secured at their ends one to each leg of the bracket, and at the other end of each arm is an upturned finger. A platform is laid over and supported by the arms and secured to the fingers. This platform is adapted for mounting a keyboard thereon and has a plurality of friction pins extending therethrough arranged for securement to the keyboard.

To permit the keyboard mounted on the carrier platform to be removed with the platform, the platform may have rods projecting along its longitudinal axis which cooperate with slots arranged in the arms so that the rods are pivoted in the slots, permitting the platform to be swung down on the arms and connected to the fingers, or when detached from the fingers to be swung up and lifted off the arms for removal from the carrier.

In all cases the fastener members for securing the carrier together and for mounting the keyboard on the carrier platform are removable and arranged to permit exact locating of the keyboard on the carrier and to retain the carrier fixed relative to the brace and plate assembly.

OBJECTS AND ADVANTAGES OF THE INVENTION

It is the object of the present invention to provide a keyboard carrier of the character described.

Another object is to provide a keyboard carrier having a bracket and arms supporting a keyboard platform projecting from a brace and plate assembly attachable over the shoulders and along the belt line of a wearer.

Another object is to provide a platform for mounting a keyboard on a carrier in a horizontal position fixed relative to its means for attachment to a wearer.

Another object is to provide fingers on the support arms for holding a platform of a keyboard carrier.

Another object is to provide friction pins extending through a carrier platform arranged for securement of a keyboard thereto.

Another object is to provide cooperating rod and slot connections for pivotally securing a platform on the arms of a keyboard carrier.

Another object is to provide a keyboard carrier having a platform adapted for securing the keyboard removably thereto and for detachably securing the platform to the carrier.

Another object is to provide removably secured fasteners for detachably mounting a keyboard on a platform and for supporting a platform on the support system of the carrier.

Another object is provide a keyboard carrier which is lightweight and strong, and which is easy to manufacture and use and efficient for portably carrying a keyboard, and which is simple and inexpensive.

The above and other objects and advantages of the present invention will become more apparent as this description proceeds, particularly with reference to the accompanying drawings and the following specification.

DESCRIPTION OF A PREFERRED EMBODIMENT

Figure 1:
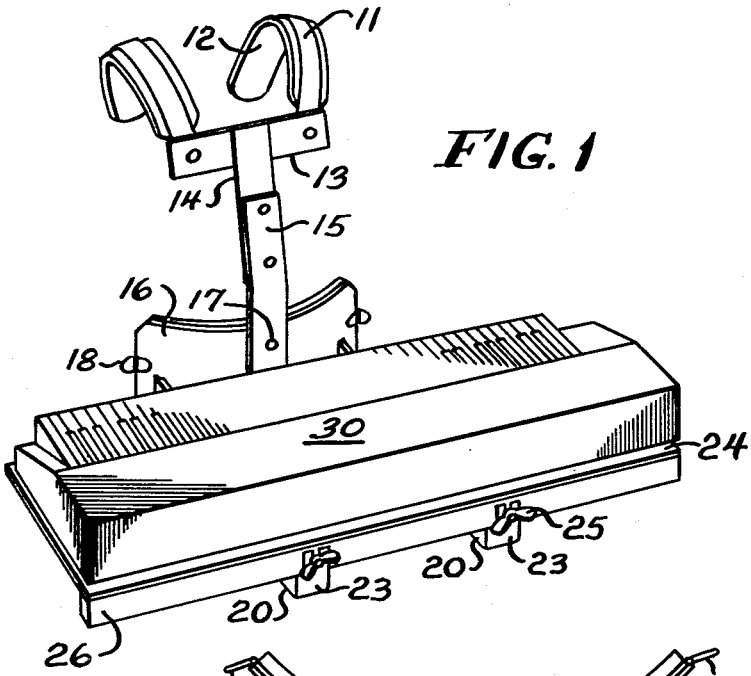
FIG. 1 is a perspective view of a keyboard carrier embodying the present invention.
Figure 4:
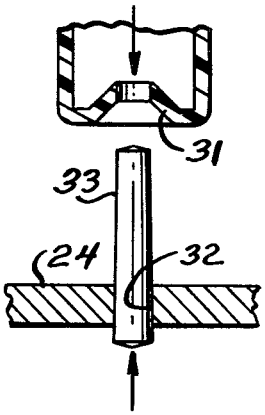
FIG. 4 is an enlarged view of the platform and friction pin assembly for mounting the keyboard.
Figure 2:
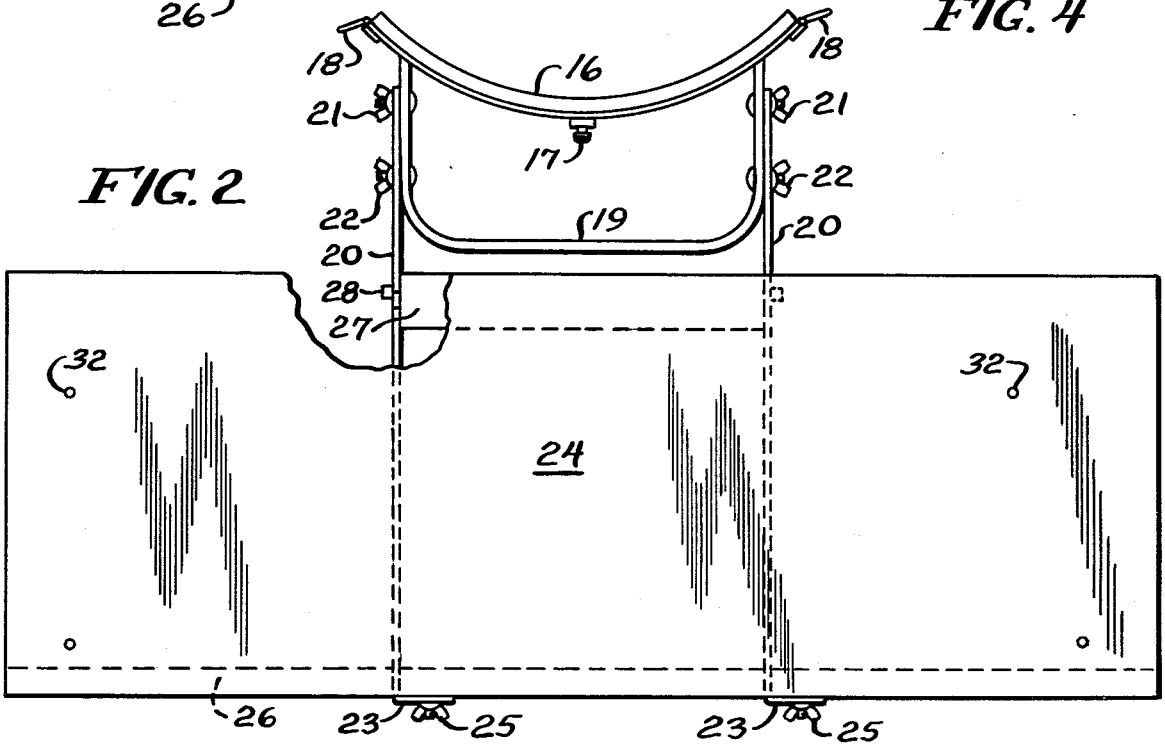
FIG. 2 is a top plan view of the keyboard carrier, without the shoulder and breast plates, and with part of the platform broken away showing its interior construction.
Figure 3:
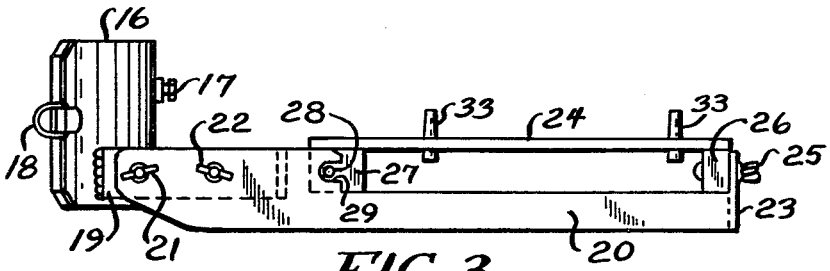
FIG. 3 is a side elevational view of the carrier shown in FIG. 2.

A keyboard carrier embodying the present invention may be attached to a wearer by means of shoulder plates 11, which preferably have pads 12 secured thereon, joined together by a yoke 13, having depending therefrom upper and lower adjustable breast plates, 14 and 15, respectively, to which a curved belt plate 16 may be secured. Preferably, the lower breast plate 15 is formed with a pair of aligned slots and the belt plate 16 has a stud 17 for receiving one of the slots. At each end of the belt plate 16 is a hook 18 to which a belt may be connected around the wearer.

Projecting from the belt plate 16 is a u-shaped bracket 19 and an arm 20 is connected to each leg of the bracket, preferably by means of longitudinally aligned wing nut and bolt assemblies 21 and 22, one on each leg of the bracket 19. At the end of each of these arms 20 is an upturned finger 23, and a platform 24 is laid over the arms and secured to the fingers 23, preferably by another wing nut-bolt assembly 25, one through each finger, and through a post 26 joined integrally with the platform 24. At the opposed edge of the platform is another brace 27 joined integrally therewith from which a rod 28 projects at each end thereof, and these rods are pivotally secured in slots 29, one in each arm 20.

The base of the keyboard 30 is conventionally formed with apertured feet 31. Apertures 32 aligned with each of the apertured feet 31 are arranged through the platform 24, and tapered friction pins 33 are wedged through the platform apertures 32 and into the apertured feet 31 of the keyboard 30.

In use, the keyboard 30 may be secured to the platform 24 by means of the friction pins 33 wedged through the platform apertures 32 and into the keyboard apertured feet 31. The platform 24 may be easily connected to the arms 20 by pivoting the rods 28 into the arm slots 29 and locked down by the wing nut-bolt assemblies 25 secured to the fingers 23 through the platform post 26. The arms 20 are connected to the u-shpaed bracket 19 by means of the wing nut-bolt assemblies 21 and 22. The shoulder plates 11 are mounted on the wearer, with the upper and lower breast plates 14 and 15 adjusted to a suitable height, whereupon the entire carrier assembly, with the arms 20 supporting the platform 24 and the keyboard 30 mounted thereon, may be joined together by slipping the stud 17 into one of the breast plate slots.

Should a musician care to remove the keyboard 30 from the carrier, he may disassemble the arms 20 from the u-shaped bracket 19 by withdrawing the wing nut-bolt assemblies 21 and 22. The musician may also free the keyboard from the platform 24 by withdrawing the tapered friction pins 33 from the keyboard apertured feet 31 through the underside of the platform; or he may remove the wing nut-bolt assemblies 25 from the fingers 23 and platform post 26, and merely tilt up the platform 24 pivoted on the rods 28 and arm slots 29, withdrawing the platform with the keyboard mounted thereon from the arms 20.

When the entire keyboard carrier is assembled as described, the device moves as a unit with the player and the keyboard is secured at a proper playing height. When assembled, the keyboard 30 will not slip or slide relative to the platform 24, always arranged at a proper playing position.

While a preferred embodiment of the invention has been shown and described, many changes and modifications may be made without departing from the spirit or scope of the invention, and it is not desired that the invention should be limited to the exact construction shown and described.

I claim:

1. In a keyboard carrier having a brace and plate assembly attachable over the shoulders and along the belt line of a wearer, said keyboard carrier in combination comprising: bracket means extending from and connected to said brace and plate assembly, spaced apart horizontally extending arms each secured at one end thereof to said bracket means, an upturned finger at an end of each of said arms remote from said bracket means, and a platform removably supported by said arms and secured to said fingers, said platform being adapted for removably mounting a keyboard thereon, each of said arms and said platform having pivotably connecting means located intermediate said bracket means and said finger.

2. In the keyboard carrier recited in claim 1, wherein said bracket means comprises a u-shaped member having legs on opposed ends thereof fixed to said brace and plate assembly.

3. In the keyboard carrier recited in claim 2, wherein each of said arms is connected to one of said bracket legs by horizontally aligned spaced apart detachably secured fasteners.

4. In the keyboard carrier recited in claim 3, wherein the distance between said spaced apart arms is defined by the distance between the legs of said u-shaped bracket.

5. In the keyboard carrier recited in claim 1, wherein said pivotable connecting means comprises slots on said arms and rod means projecting from said platform adapted for pivotal movement in said slots.

6. In the keyboard carrier recited in claim 1, wherein each of said fingers have a slot opening to a free end thereof and threadable fasteners pass through said slots.

7. In the keyboard carrier recited in claim 6, wherein said platform has a flat horizontally extending upper surface and reinforcement means joined integrally with and depending from said platform through which said threadable fasteners and rod means extend beneath the plane of said platform.

8. In the keyboard carrier recited in claim 1, wherein said platform has apertures arranged at locations defined by said keyboard, and fasteners extend through said apertures adapted for removably securing said keyboard on said platform.

9. In the keyboard carrier recited in claim 8, wherein said fasteners comprise tapered friction pins wedged in said apertures.

* * * * *